US009897362B2

(12) United States Patent
Lee

(10) Patent No.: US 9,897,362 B2
(45) Date of Patent: Feb. 20, 2018

(54) ICE MAKER AND REFRIGERATOR HAVING THE SAME

(71) Applicant: LG ELECTRONICS INC., Seoul (KR)

(72) Inventor: Byoungjun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/177,645

(22) Filed: Jun. 9, 2016

(65) Prior Publication Data

US 2017/0003061 A1 Jan. 5, 2017

(30) Foreign Application Priority Data

Jun. 30, 2015 (KR) ..... 10-2015-0092939

(51) Int. Cl.
*B67D 7/80* (2010.01)
*F25C 5/04* (2006.01)
*F25C 5/00* (2018.01)

(52) U.S. Cl.
CPC ..... *F25C 5/04* (2013.01); *F25C 5/005* (2013.01); *F25C 2700/02* (2013.01)

(58) Field of Classification Search
CPC .. F25C 5/05; F25C 5/185; F25C 5/005; F25C 2700/02
USPC ..... 222/146.6; 62/71–74, 135, 340, 344, 62/353, 354
See application file for complete search history.

(56) References Cited

U.S. PATENT DOCUMENTS 7,143,588 B2 * 12/2006 Cole ..... F25C 1/04 62/347
7,628,030 B2 * 12/2009 Visin ..... F25C 1/10 62/344
2012/0180504 A1 * 7/2012 An ..... F25C 5/06 62/71

FOREIGN PATENT DOCUMENTS

JP H 11-123696 A 5/1995
KR 10-2011-0006870 A 1/2011
KR 10-2013-0078531 A 7/2013

OTHER PUBLICATIONS

Korean Office Action dated May 23, 2016 issued in Application No. 10-2015-0092939.

* cited by examiner

*Primary Examiner* — Lien Ngo
(74) *Attorney, Agent, or Firm* — KED & Associates, LLP

(57) ABSTRACT

An ice maker and a refrigerator including an ice maker are provided. The ice maker may include a tray including at least one projection that extends and protrudes from an inner surface of the tray, an ejector that rotates to separate the ice from the tray, and an ice separation motor connected to a side of the ejector to provide power to rotate the ejector so that the ice maker may effectively discharge ice out of the tray and the ice maker.

17 Claims, 11 Drawing Sheets

ICE MAKER AND REFRIGERATOR HAVING THE SAME

CROSS-REFERENCE TO RELATED APPLICATIONS

This application claims priority under 35 U.S.C. 119 to Korean Patent Application No. 10-2015-0092939 filed on Jun. 30, 2015, whose entire disclosure is incorporated herein by reference in its entirety.

BACKGROUND

1. Field

An ice maker and a refrigerator having the same are disclosed herein.

2. Background

A refrigerator is a home appliance that stores food at a low temperature in an internal storage space. The internal storage space may be cooled using cool air generated by heat exchange of a refrigerant circulated through a refrigeration cycle. Refrigerators have become bigger and may include many functions based on demand, and refrigerators with various structures and equipment for user convenience are being released.

For example, an ice maker configured to make and store ice may be provided in a refrigerator at a position such as, e.g., inside a freezer compartment door. Various types of the ice maker may include an ice maker that automatically manufactures, separates, and stores ice, and extracts the stored ice. A refrigerator having this type of ice maker may able to extract or dispense ice out of the refrigerator through a dispenser. In addition, a refrigerator may have an ice maker type that counts and extracts a desired number of pieces of the stored ice through the dispenser according to a user's selection.

Referring to FIG. 1, an ice maker 10 of related art may include an ice tray 11, an ice separation motor 13 and an ejector 12. The ice tray 11 may be a tray that provides a space for ice and may be formed into a semicircular shape, in which an inside lower surface thereof may have a constant curvature. The ice separation motor 13 may be provided on one side of the ice tray 11, connected to the ejector 12, and may rotate the ejector 12. The ejector 12 may be rotated along a curved surface of an ice space formed by an inner surface of the ice tray 11.

When ice is formed in the ice tray 11, the ice separation motor 13 may transfer a rotational power or force to the ejector 12, and, while being rotated, the ejector 12 may lift and discharge the ice in the ice tray 11 out of the tray 11. However, the ice maker 10 may not properly transfer ice out of the ice maker 10.

Referring to FIGS. 2A and 2B, during an ice separation process by the ejector 12 after ice formation is completed, ice may not be discharged out by rotation of the ejector 12 and may be left on a rear end of the ice tray 11. When the ejector 12 rotates to separate ice later, the ejector 12 may then be damaged or rotation of the ejector 12 may be stopped due to interference of the ice left on the ice tray 11.

BRIEF DESCRIPTION OF THE DRAWINGS

The embodiments will be described in detail with reference to the following drawings in which like reference numerals refer to like elements wherein.

DETAILED DESCRIPTION

Figure 1:
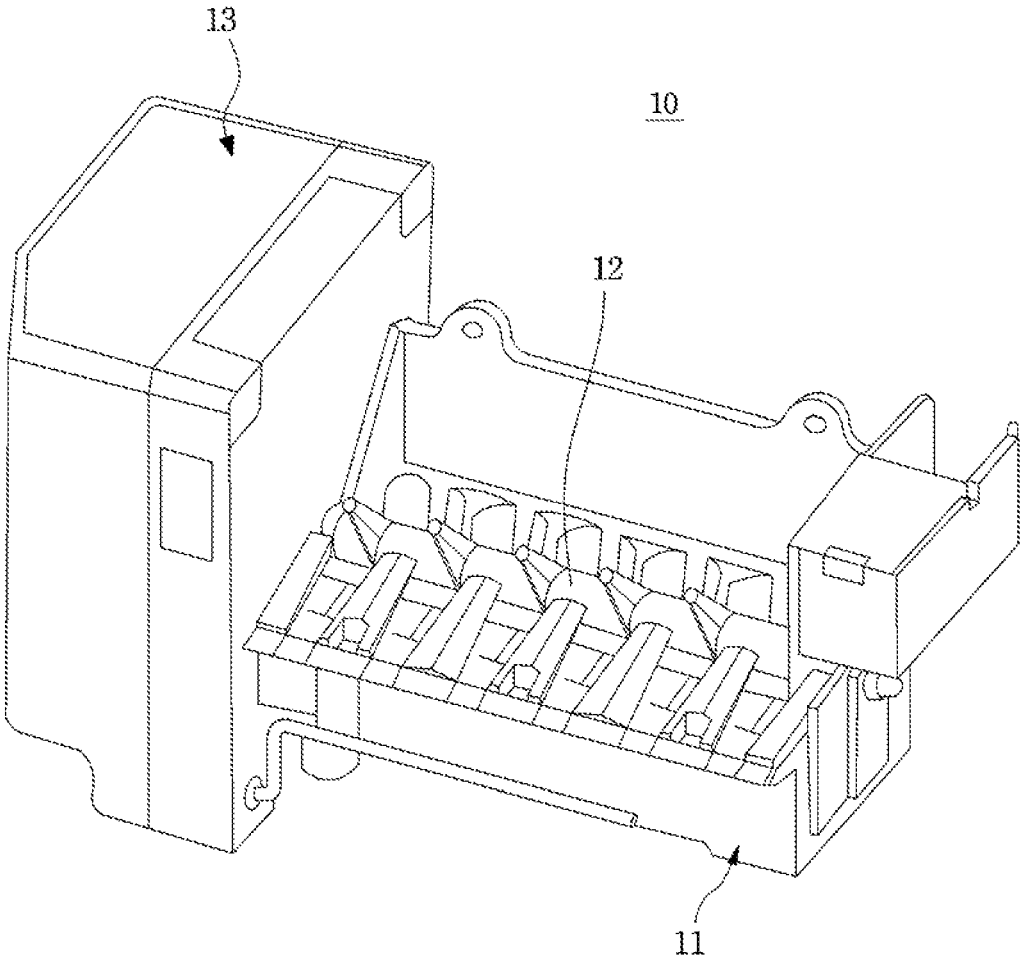
FIG. 1 RELATED ART
FIG. 1 is a perspective view of an ice maker.
Figure 2A:
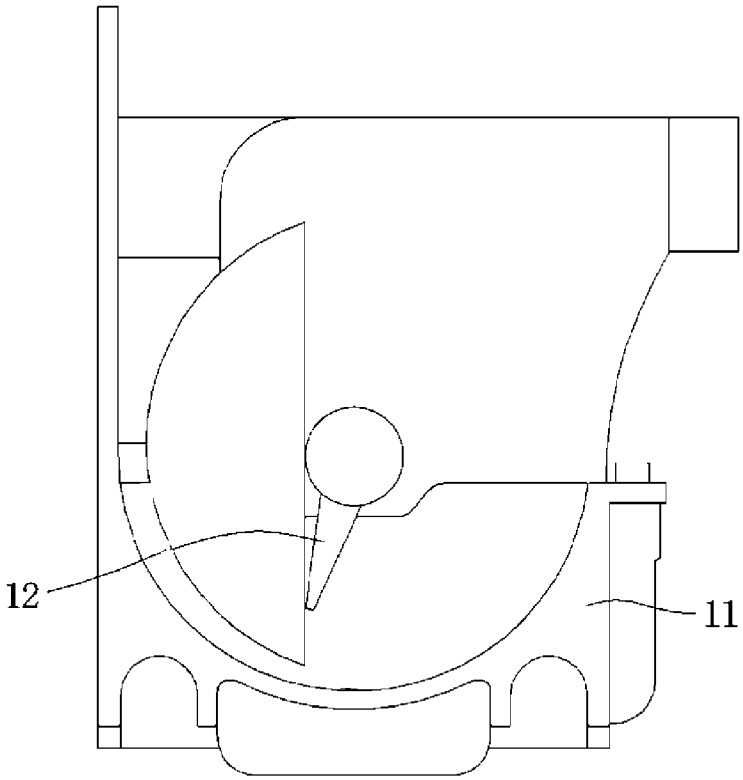
FIG. 2A RELATED ART
FIGS. 2A and 2B are side views showing a process for separating ice according to an operation of the ice maker of FIG. 1.
Figure 2B:
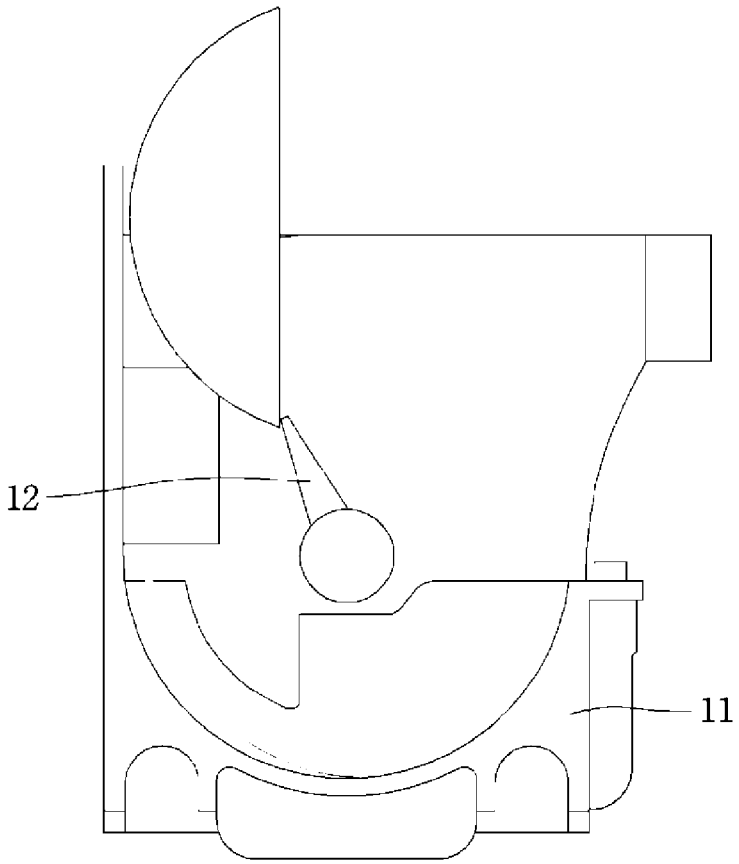
FIG. 2B RELATED ART
Figure 3:
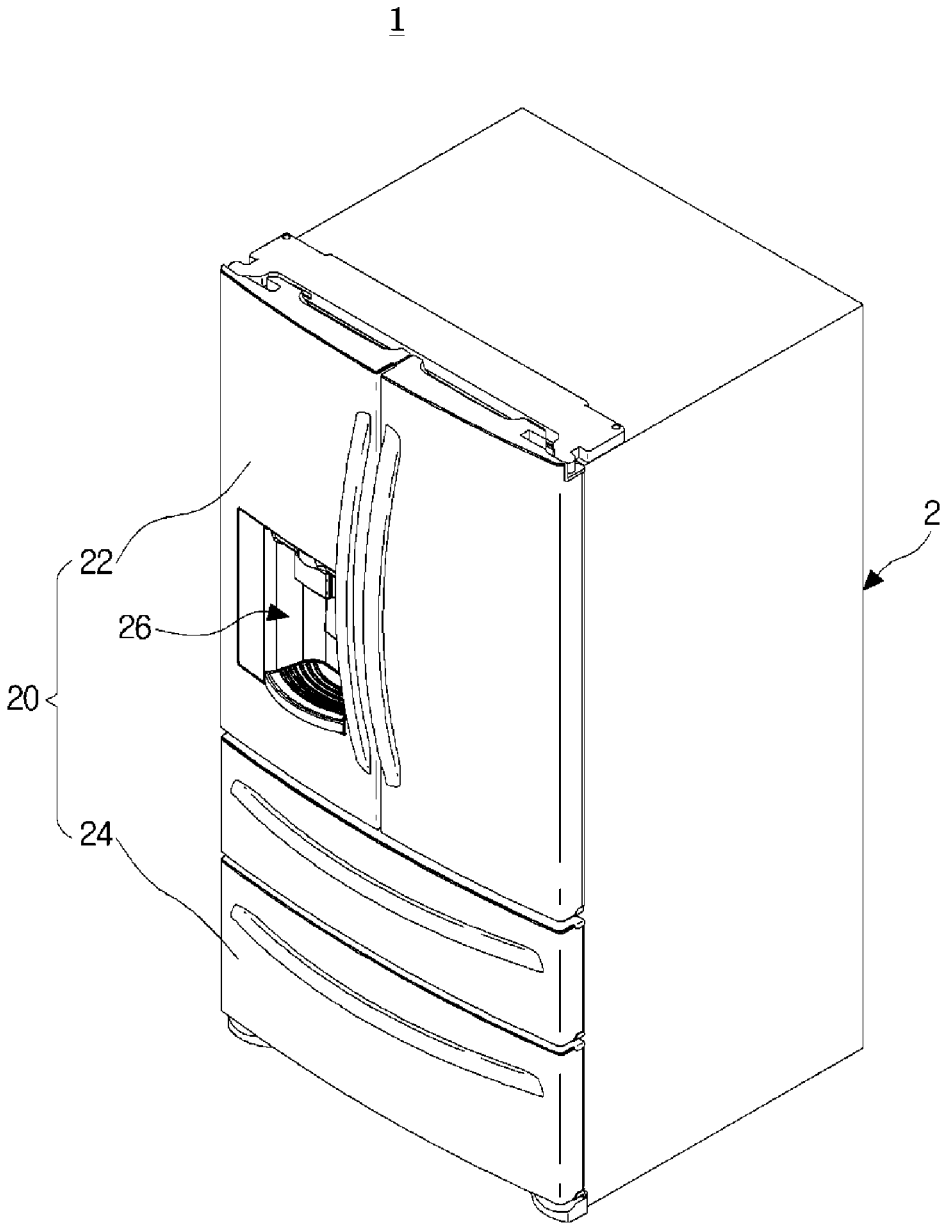
FIG. 3 is a perspective view of a refrigerator including an ice maker according to an embodiment.
Figure 4:
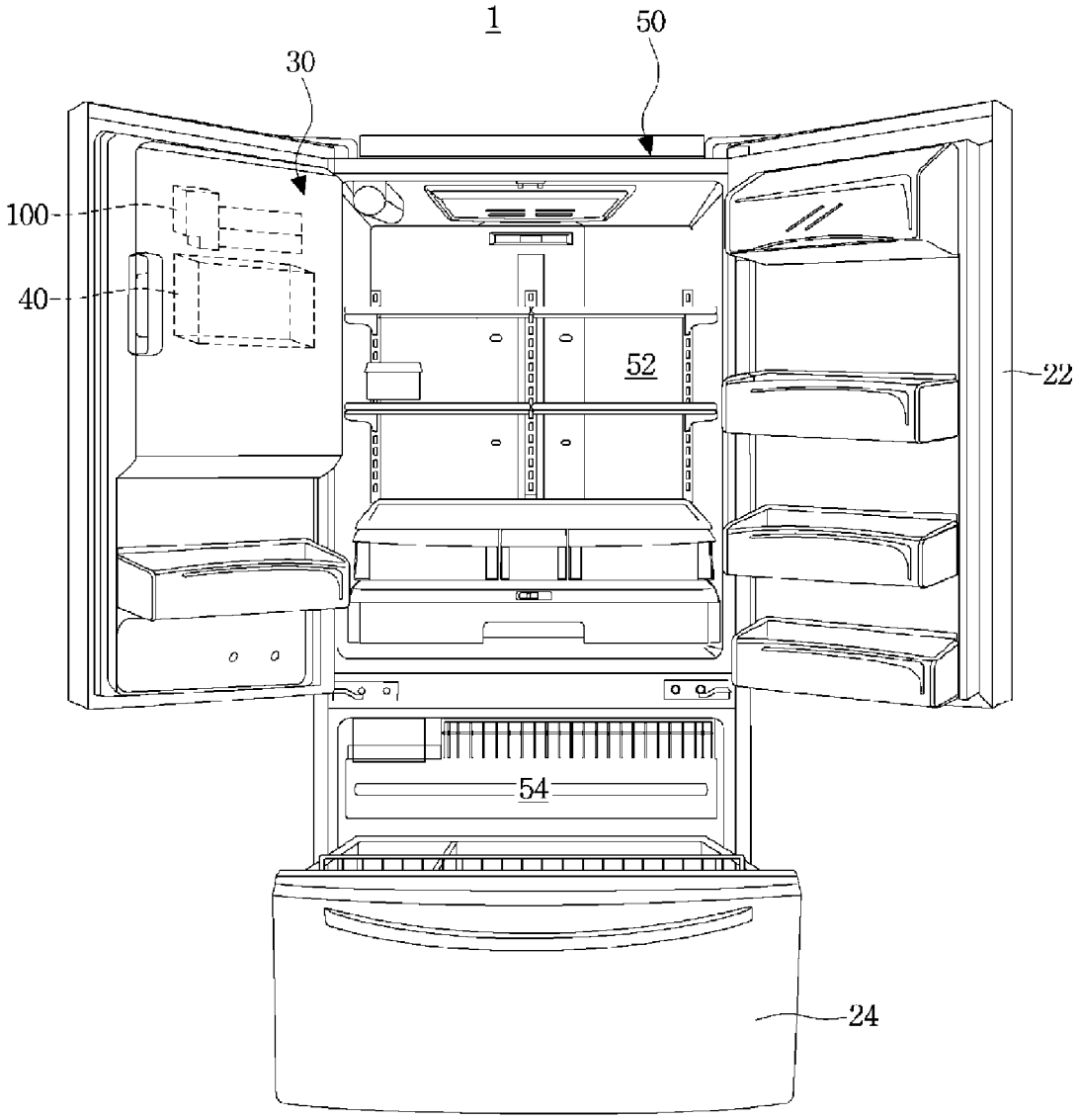
FIG. 4 is a front view of an opened refrigerator including an ice maker according to an embodiment.

Referring to FIGS. 3 to 4, an outer shape of a refrigerator 1 according to an embodiment may be provided by a cabinet 2 that forms a storage space, and a door 20 that opens and closes the storage space. For example, the cabinet 2 may form a storage space 50, which may be partitioned into two sections, where a refrigerator compartment 52 may be provided on a top section, and a freezer compartment 54 may be provided on a bottom section. A storage member such as a drawer, a shelf, and/or a basket may be provided inside of the refrigerator compartment 52 and/or the freezer compartment 54.

The door 20 may include a refrigerator compartment door 22 to open and close the refrigerator compartment 52 and a freezer compartment door 24 to open and close the freezer compartment 54. The refrigerator compartment door 22 may include one pair of left and right doors and may be opened and closed via rotation. The freezer compartment door 24 may be drawn out, for example, like a drawer. As an arrangement of the refrigerator compartment 52, the freezer compartment 54, and a shape of the door 20 may change depending on refrigerator type, embodiments disclosed herein may be applied to various types of refrigerators and are not limited thereto.

An ice chamber 30 may be provided in the refrigerator compartment door 22. The ice chamber 30 may be an insulated, separate space in the refrigerator compartment door 22 and may be a space in which ice may be created and stored and cool air supplied from the freezer compartment 54 or an evaporator may flow. An ice maker 100, which may make ice, may be provided at an inside or an inner side of the ice chamber 30. The ice maker 100 may automatically supply water from a refrigerator or a water source of the refrigerator and, when the water is frozen and ice is made, may be configured to allow the ice to be separated automatically. An ice bank 40, in which the ice is separated from the ice maker 100 and stored, may be placed under or provided on a bottom of the ice maker 100.

Then, a dispenser 26 that extracts or dispenses the ice out of the dispenser 26 may be provided on a front surface of the refrigerator compartment door 22, in which the ice chamber 30 may be provided. The dispenser 26 may communicate with the ice chamber 30. The dispenser 26 may also be configured to dispense water. The ice chamber 30 may be provided in the refrigerator compartment 52, and may communicate with the dispenser 26 while the refrigerator compartment door 22 is closed.

The ice maker 100 may be provided in not only the ice chamber 30 but also in the freezer compartment door 24 or freezer compartment 54, and may be located at any available position where ice may be made, such as, e.g., in the refrigerator or an inner surface of a refrigerator door. The ice maker 100 may also be variously configured according to a water supply method and an ice separation method.

Figure 5:
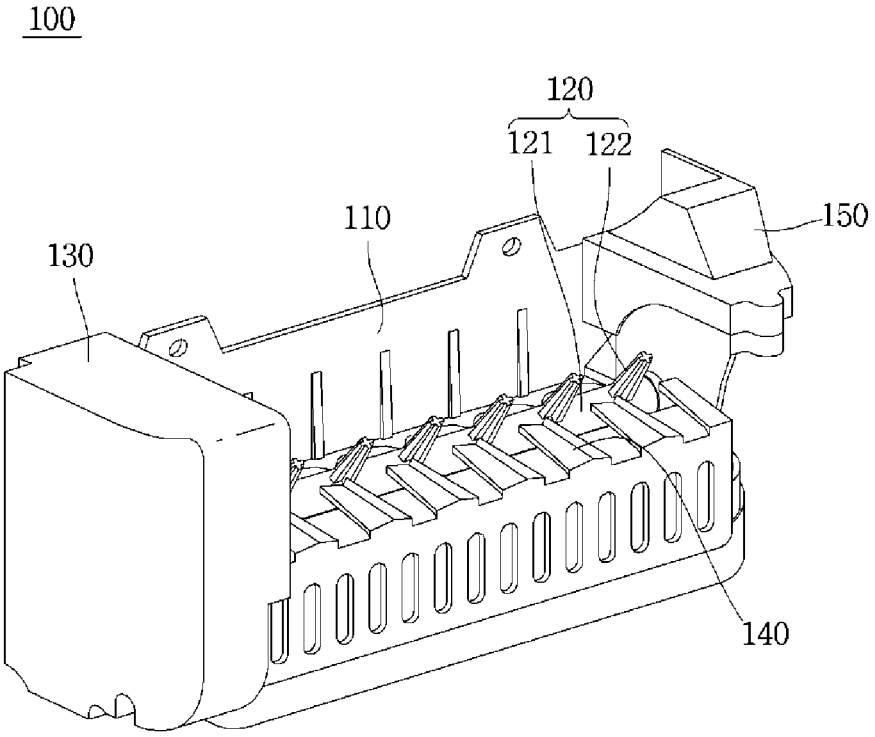
FIG. 5 is a perspective view of an ice maker according to an embodiment.
Figure 6:
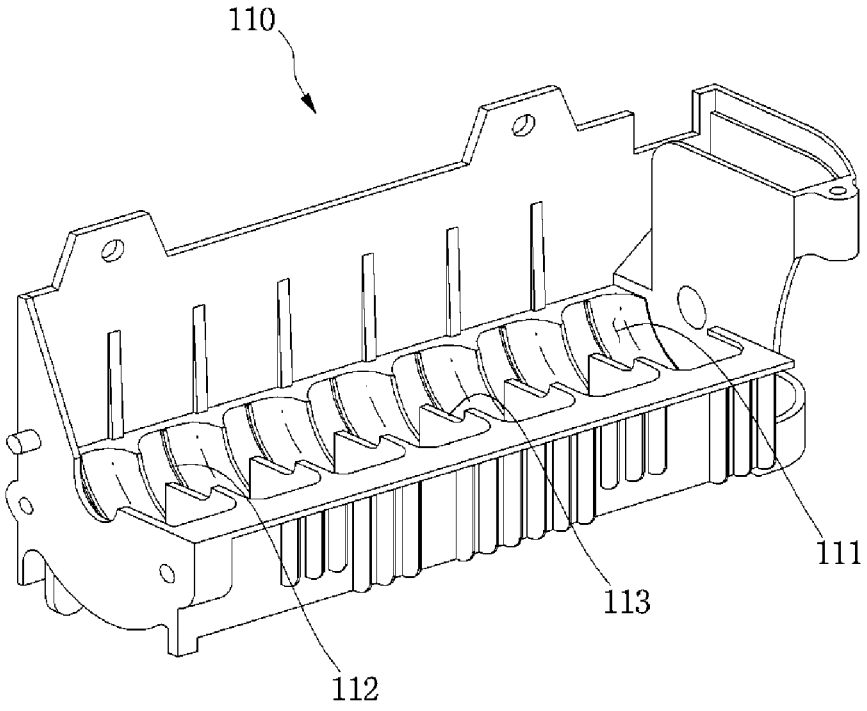
FIG. 6 is a perspective view of an ice tray configuration of an ice maker according to an embodiment.

Referring to FIGS. 5 to 6, the ice maker 100 may provide a space, in which the ice is made. The ice maker 100 may include an ice tray or tray 110, in which one or more projections 112 that protrudes in a direction in which the ice is separated may be formed, an ejector 120 to discharge the ice from the ice tray 110 out of the tray, and an ice separation motor or ice separator 130 to drive the ejector 120. The ice separation motor 130 may be provided at a side of the ice maker 100. A plurality of gears, such as, e.g., an electric motor to rotate the ejector 120, may be provided inside the ice separation motor 130.

The ejector 120 may be connected to one side of the ice separation motor 130. The ejector 120 that separates the ice made at or in the ice tray 110 out of the ice tray 110 may include an ejector shaft 121, which may be connected to the one side of the ice separation motor 130 and rotated, and one or more ejector fins 122, which may extend from the ejector shaft 121 to scoop the ice made. An ice sensor may be provided on another side of the ice separation motor 130. The ice sensor may be rotated by the ice separation motor 130, and, while rotating, the ice sensor may be configured to detect whether the ice bank 40 is full of ice.

A stripper 140 may be provided on an upper surface of the ice tray 110. The stripper 140 may cover a portion of an open upper surface of the ice tray 110 and may have a partially cut shape so that the ejector 120 may pass therethrough. The stripper 140 may be formed of an elastically deformable material. The stripper 140 may prevent water accommodated in the ice tray 110 from overflowing and, concurrently, when the ice is separated by the ejector 120, may guide the separated ice to a front of the ice tray 110.

Figure 7:
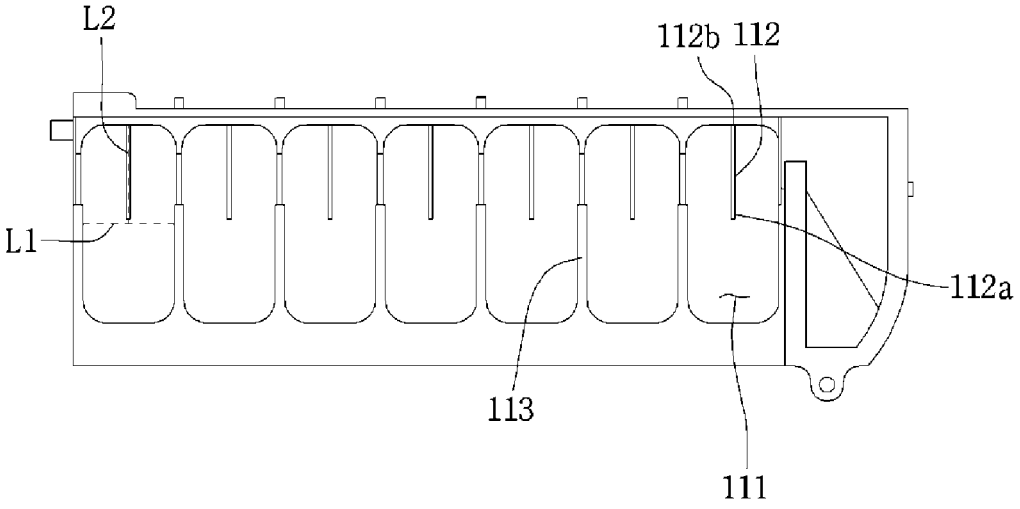
FIG. 7 is a top view of the ice tray configuration of the ice maker according to the embodiment of FIG. 6.
Figure 8:
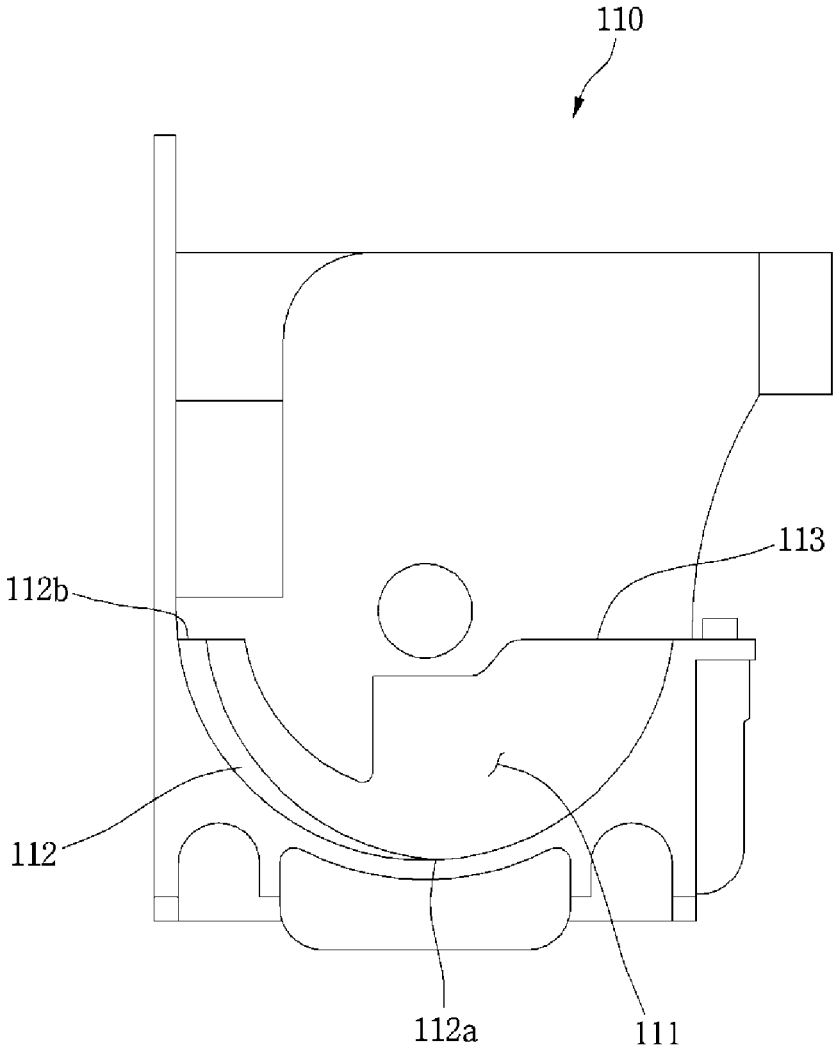
FIG. 8 is a side view of the ice tray configuration of the ice maker according to the embodiment of FIG. 6.

Referring to FIGS. 7 to 8, the ice tray 110 may be provided on the one side of the ice separation motor 130. The ice tray 110 may form an ice space or space 111, in which water may be supplied and frozen to form ice. The ice tray 110 may be formed of a plastic material or a metal material, for example, aluminum, which has excellent heat transfer performance, or an aluminum alloy. The ice space 111 of the ice tray 110 may be partitioned into a plurality of spaces by a plurality of partition plates 113. The plurality of partition plates 113 may protrude from an inner surface of the ice tray 110 and may extend a predetermined length. A height of at least a portion of each of the plurality of partition plates 113 may be formed lower than a height of the ice tray 110 so that water supplied into the ice tray 110 may move to each partitioned space of the ice space 111 and be uniformly supplied.

A fixture 150 (see FIG. 5) may be formed at one side of the ice tray 110 so as to fix the ice tray 110 or the ice maker 100 to an inside of the ice manufacture chamber 30. A water supplier, which may automatically provide water to be supplied to the ice tray 110, may be provided on an upper side of the ice tray 110. A temperature sensor, which may detect a temperature of the ice tray 110, and/or a temperature sensor, which may detect a temperature of the inside of the ice manufacture chamber 30, may also be provided. A heater, which may heat the ice tray 110 during ice separation, may be provided in a lower portion of the ice tray 110 as needed.

The ice space 111 of the ice tray 110 may be in a shape having a curved surface with a predetermined curvature when viewed from a side. The ice space 111 may be in a shape having a curved surface with a same curvature as a rotation curvature of the ejector 120. For example, when viewed from the side, the ice space 111 may be a semicircular shape, of which an upper portion may be cut off. A plurality of projections 112 having a curvature, which may be a same as or similar to a curvature of the ice space 111, may be formed at a position between the plurality of partition plates 113 that partition the ice space 111 of the ice tray 110. The plurality of projections 112 formed between the plurality of partition plates 113 may be extended in a direction which may be a same direction as a rotation direction of the ejector 120, for example, a direction in which the ice is separated.

Each of the plurality of projections 112 may protrude from and be formed in an inner surface of the ice space 111 so that the inner surface of the ice space 111 may be spaced apart from a piece of ice 1. The ice space 111 may be divided into an insertion area, in which the ejector 120 may be inserted, and a withdrawal area, from which the ejector 120 may be withdrawn. When a first reference line L1, which may be parallel to an extension direction of the shaft of the ejector 120 and bisect an area between the insertion area and the withdrawal area, is defined, some or all of the plurality of projections 112 may be located on an inner surface of the space between the first reference line L1 and the withdrawal area. This configuration may be for tilting toward a forward end direction of the ice tray 110 when the ice is separated by the ejector 120 or when the ice is located at a rear end of the ice tray 110. The projection 112 may be extended to the withdrawal area. The projection 112 may extend from first reference line L1 to the withdrawal area or from the insertion area to the withdrawal area.

A forward end 112*a* of the projection 112 may protrude and extend from a lowest side of the inner surface of the ice space 111 of the ice tray 110, and as it extends toward a rear end 112*b* of the projection, a projection height may gradually increase while having an certain curvature, and the rear end 112*b* of the projection may protrude at a greater height that a height of the forward end 112*a* from the rear end of the ice space 111 of the ice tray 110. For example, the forward end 112*a* of the projection 112 may be a portion near the insertion area, and the rear end 112*b* of the projection 112 may be a portion near the withdrawal area. A protrusion height of the forward end 112*a* of the projection 112 may be lower than a protrusion height of the rear end 112*b* of the projection 112. An upper surface of the forward end 112*a* of the projection 112 and an upper surface of the rear end 112*b* of the projection 112 may be a curved shape having a set curvature such that a line connecting the rear end 112*b* from the forward end 112*a* may be one curved line.

For example, the forward end 112*a* of the projection 112 may gradually protrude at a same height as a lowest surface of the ice tray 110 and form a certain curvature to the rear end 112*b*. Thus, the projection 112 may be formed in a shape in which the rear end 112*b* of the projection 112 has a greater height than a height of the forward end 112*a* of the projection 112. A height from the inner surface of the ice tray 110 to the upper surface of the rear end 112*b* of the projection 112 may be greater than a height from the inner surface of the ice tray 110 to the upper surface of the forward end 112*a* of the projection 112. The rear end 112*b* of the projection 112 may be round. Even if the rear end 112*b* formed to be round is compared to the rear end 112*b* formed to be a right angle shape, the ice separation effect may be similar and forming the rear end 112*b* to be round may be effective for lowering manufacturing costs.

A portion of the projection 112 may be located on a second reference line L2, which may bisect the ice space 111 in a direction perpendicular to an extension direction of the ejector shaft 121. For example, an extension line from the forward end 112*a* to the rear end 112*b* and the second reference line L2 may be parallel to each other. The projection 112 may be formed so that an extension direction of the projection 112 may be parallel to the second reference line L2. A width of the projection 112 may be smaller than a width of the ice generated in the ice space 111. For example, a width of the projection 112 may have a width only so that an upper surface of the projection 112 may support the ice. The narrower the width of the projection 112, the more an amount of ice separated from the ice space 111 may be.

Figure 9A:
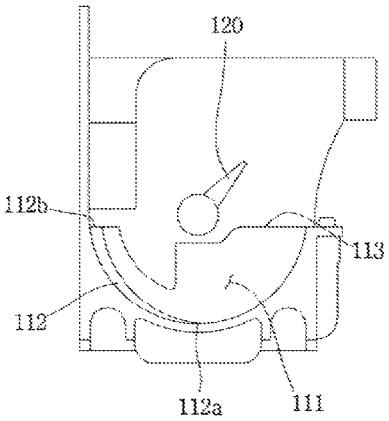
FIGS. 9A, 9B, and 9C are side views showing a process for separating ice according to an operating of an ice maker according to an embodiment.
Figure 10A:
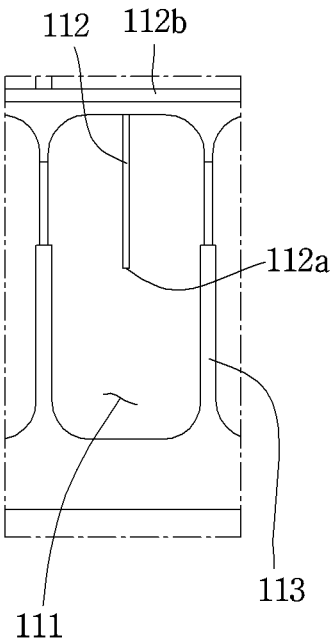
FIGS. 10A, 10B, and 10C are views showing a process for separating ice from an upper surface of an ice maker according to an embodiment.

Referring to FIGS. 9A and 10A, water or purified water may be supplied to the ice tray 110 of the ice maker 100 according to an embodiment from a water supplier of the refrigerator. A water level of water supplied from the water supplier may be equal or greater than a predetermined height of the partition plate 113 of the ice space 111 so as to equalize an amount of water supplied to the ice tray in each of the ice spaces 111 divided by the partition plate 113.

Figure 9B:
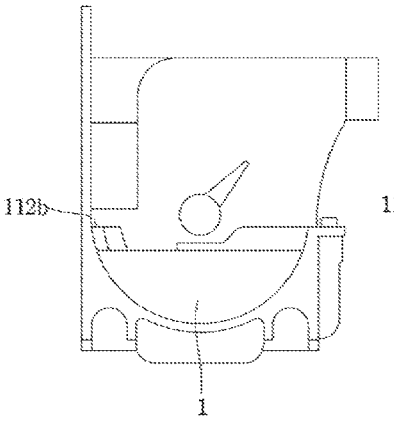
Figure 10B:
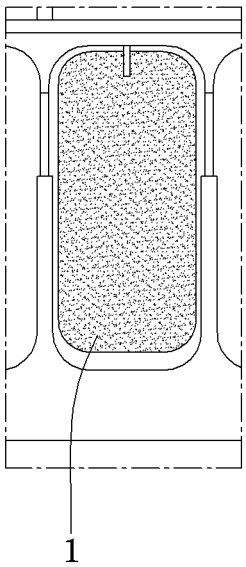

Referring to FIGS. 9B and 10B, when water is supplied to the ice tray 110, cool air supplied by the freezer compartment or evaporator may freeze the water in the ice tray 110 to produce or form ice 1. As the projection 112 and the partition plate 113 are formed in the ice space 111 of the ice tray 110, a predetermined groove may be formed in a portion of a lower surface of the ice 1.

Figure 9C:
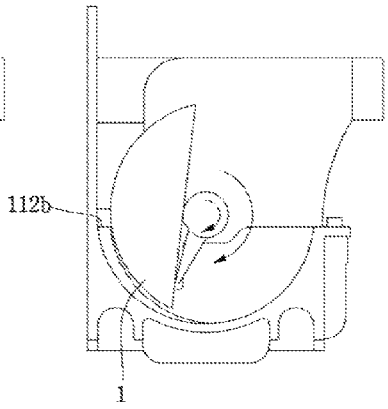
Figure 10C:
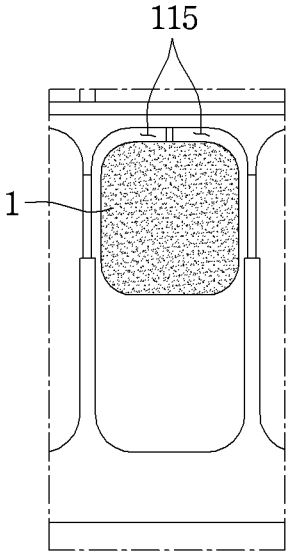

Referring to FIGS. 9C and 10C, when ice 1 is formed in the ice tray 110, the ice separation motor 130 may operate to rotate the ejector shaft 121. While the ejector shaft 121 is rotating, the one or more ejector fins 122 formed on a side of the ejector shaft 121 may push the ice 1 up to a rear portion of the ice tray 110. A groove made by the projection 112 may be formed in the lower surface of the ice from a middle portion of the ice 1 to the rear end, but a groove may not be formed in the lower surface from a forward end of the ice 1 to the middle portion.

When the ice 1 is being pushed up to the rear portion of the ice tray 110 by the ejector fin 122, since a groove is not formed in a lower surface from a forward end of the ice 1 to the middle portion, and while the lower surface of the ice 1 is in contact with the upper surface of the projection 112 and moving, the ice 1 may be pushed up to the rear portion of the ice tray 110. At this time, between the inner surface of the ice 1 and the ice tray 110, an empty space 115 having a depth of as much as a height of the projection 112 may be present in the ice space 111 to a position of both sides of the projection 112. That is, an inner surface of the ice space 111 of the ice tray 110 and the ice 1 may be spaced apart from each other.

As a contact surface between the inner surface of the ice tray 110 and an outer surface of the ice 1 is decreased and the empty space 115 increases, surface tension between the ice tray 110 and the ice 1 may be reduced. Thus, the ice 1 may be easily discharged out of the ice tray 110 by the ejector fin 122 compared to an ice maker such as ice maker 10.

While the ice 1 is pushed up by the ejector fin 122, when a lower surface center portion of the ice 1 is in contact with an upper surface of the rear end 112*b*, since the rear end 112*b* protrudes a predetermined height or more from the rear end of the inner surface of the ice tray 110, the ice 1 may be pushed up while inclined toward a forward end direction of the ice tray 110.

Embodiments disclosed herein provide an ice maker, which may effectively discharge ice out of the ice maker. An ice maker according to embodiments disclosed herein may include a tray or an ice tray configured to provide space for ice to be made, an ejector that rotates to separate the ice from the tray; and an ice separation motor connected to a side of the ejector and configured to provide power to rotate the ejector. The tray may include at least one space in which the ice is made having an inner surface with a curvature, and at least one projection that protrudes from the inner surface of the space so that a portion of the ice is spaced apart from the inner surface of the space during rotation of the ejector.

A refrigerator according to embodiments disclosed herein may include at least one door, an ice chamber that provides space for ice to be made, the ice chamber being provided on the at least one door or in a compartment of the refrigerator, an ice maker provided inside of the ice chamber and in which the ice is made, and a dispenser that communicates with the ice chamber at a front surface of the at least one door and dispenses the ice made out of the at least one door. The ice maker may include a tray that provides one or more spaces for ice to be made, an ejector that rotates to separate the ice from the tray, and an ice separation motor connected to a side of the ejector and configured to provide power to rotate the ejector. The tray may includes at least one space in which the ice is made having an inner surface with a curvature and at least one projection that protrudes from the inner surface of the at least one space so that the ice is spaced apart from the inner surface of the at least one space during rotation of the ejector.

Terms such as first, second, A, B, (a), (b) or the like may be used herein when describing components of the embodiments. Each of these terminologies is not used to define an essence, order or sequence of a corresponding component but used merely to distinguish the corresponding component from other component(s). If it is described in the specification that one component is "connected," "coupled" or "joined" to another component, the former may be directly "connected," "coupled," and "joined" to the latter or "connected", "coupled", and "joined" to the latter via another component.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice maker comprising:

a tray configured to provide a space for formation of ice;

an ejector that rotates to separate the ice from the tray; and an ice separation motor connected to a side of the ejector and configured to provide power to rotate the ejector, wherein the tray includes:

a plurality of partition plates to partition the space of the tray into a plurality of spaces, each of the plurality of spaces having an inner surface with a curvature; and at least one space of the plurality of spaces includes at least one projection that protrudes from the inner surface of the at least one space so that a portion of the ice is spaced apart from the inner surface of the at least one space during rotation of the ejector, wherein the at least one projection is formed at a position between the plurality of partition plates.

2. The ice maker of claim 1, wherein the at least one projection is extended in a same direction as a direction in which the ice is separated from the inner surface of the at least one space.

3. The ice maker of claim 1, wherein the at least one projection forms a groove on a lower surface of the ice.

4. The ice maker of claim 1, wherein, based on the ejector, the at least one space includes an insertion area in which the ejector is inserted, and a withdrawal area from which the ejector is withdrawn, and based on a first reference line that bisects between the insertion area and the withdrawal area, a portion or all of the at least one projection is located between the withdrawal area and the first reference line.

5. The ice maker of claim 4, wherein the at least one projection extends to the withdrawal area.

6. The ice maker of claim 4, wherein the at least one projection includes a forward end and a rear end, which is closer to the withdrawal area than the forward end, and a protrusion height of the at least one projection at the rear end is higher than a protrusion height of the at least one projection at the forward end.

7. The ice maker of claim 6, wherein a protrusion height of the at least one projection increases toward the rear end from the forward end.

8. The ice maker of claim 7, wherein a line that connects the forward end and the rear end of the at least one projection is curved.

9. The ice maker of claim 6, wherein the rear end of the at least one projection is formed to be round.

10. The ice maker of claim 6, wherein a portion of the at least one projection is located on a second reference line that bisects the at least one space in a direction perpendicular to an extension direction of a shaft of the ejector.

11. The ice maker of claim 10, wherein an extension line that extends from the forward end to the rear end of the at least one projection is parallel with the second reference line.

12. The ice maker of claim 1, wherein a width of the at least one projection is smaller than a width of the ice made in the at least one space.

13. A refrigerator comprising:

at least one door;

an ice chamber that provides space for ice to be made, the ice chamber being provided on the at least one door or in a compartment of the refrigerator;

an ice maker provided inside of the ice chamber and in which the ice is made; and a dispenser that communicates with the ice chamber at a front surface of the at least one door and dispenses the ice made out of the at least one door, wherein the ice maker includes:

a tray that provides space for ice to be made;

an ejector that rotates to separate the ice from the tray; and an ice separation motor connected to a side of the ejector and configured to provide power to rotate the ejector, wherein the tray includes:

a plurality of partition plates to partition the space of the tray into a plurality of spaces, each of the plurality of spaces having an inner surface with a curvature; and at least one projection that protrudes from the inner surface of each of the plurality of spaces so that the ice is spaced apart from the inner surface of each of the plurality of spaces during rotation of the ejector, wherein the at least one projection is formed at a position between the plurality of partition plates.

14. The refrigerator of claim 13, wherein the at least one projection extends in a same direction as a direction in which the ice is separated from the inner surface of the at least one space.

15. The refrigerator of claim 14, wherein the at least one projection gradually increases in height toward an extension direction.

16. The refrigerator of claim 14, wherein an upper surface of the at least one projection is formed to have a constant curvature in an extension direction.

17. The refrigerator of claim 13, wherein a width of the at least one projection is smaller than a width of the ice made.

* * * * *